United States Patent [19]

Toda et al.

[11] Patent Number: 4,578,332

[45] Date of Patent: Mar. 25, 1986

[54] METHOD OF REMOVING ELECTROSTATIC CHARGE FROM ELECTROPHOTOGRAPHIC PHOTOSENSITIVE DEVICE

[75] Inventors: Akitoshi Toda; Yoshiyuki Mimura, both of Hachioji, Japan

[73] Assignee: Olympus Optical Co., Ltd., Tokyo, Japan

[21] Appl. No.: 669,990

[22] Filed: Nov. 9, 1984

[30] Foreign Application Priority Data

Nov. 9, 1983 [JP] Japan ..... 58-209116
Nov. 9, 1983 [JP] Japan ..... 58-209117

[51] Int. Cl.[4] ..... G03G 13/24
[52] U.S. Cl. ..... 430/55; 430/125
[58] Field of Search ..... 430/55, 125

[56] References Cited

U.S. PATENT DOCUMENTS 4,063,945 12/1977 Von Hoene et al. ..... 430/55
4,254,199 3/1981 Tutihasi ..... 430/55 X
4,265,998 5/1981 Barkley ..... 430/55 X

FOREIGN PATENT DOCUMENTS 47-18590 2/1972 Japan ..... 430/55

OTHER PUBLICATIONS

Anderson et al., "Xerographic Interenage Erase", IBM Tech. Discl. Bull., vol. 25, No. 2, Jul. 1982, p 511.

*Primary Examiner*—Roland E. Martin
*Attorney, Agent, or Firm*—Armstrong, Nikaido, Marmelstein & Kubovcik

[57] ABSTRACT

A method of removing electrostatic charge for erasing an electrostatic latent image from an electrophotographic photosensitive device having a conductive layer overlain by a photoconductive layer which in turn is overlain by a transparent insulating layer. The method comprises a first step of uniformly charging the photosensitive device by a D.C. charger while subjecting the photosensitive device to an exposure over the whole area thereof; a second step of effecting a charging for adjustment of potential level so as to adjust the potential of the photosensitive device from the level obtained as a result of the charging in the first step to the aimed level; and a third step of exposing the whole area of the photosensitive device. With this method, it is possible to remove electrostatic charge almost perfectly to eliminate undersirable shift of the potential of the photosensitive device after the erasion.

16 Claims, 8 Drawing Figures

METHOD OF REMOVING ELECTROSTATIC CHARGE FROM ELECTROPHOTOGRAPHIC PHOTOSENSITIVE DEVICE

BACKGROUND OF THE INVENTION

The present invention relates to a method of removing the electrostatic charge of an electrostatic latent image remaining on an electrophotographic photosensitive device which is formed by laminating a photoconductive layer and a transparent insulating layer on a conductive layer.

It is known that a copy of an image can be made by making use of an electrophotographic photosensitive device prepared by forming a photoconductive layer on a conductive layer and forming a transparent insulating layer on the photoconductive layer. In making the copy, an electrostatic latent image is formed on the photosensitive device. One of the following three methods is usually used for forming the electrostatic latent image when the photosensitive device is of P type:

(1) A method having a first step in which the photosensitive body is positively charged by a D.C. charger and, simultaneously, exposed to a light image, a second step in which the photosensitive device is negatively charged by a D.C. charger, and a third step in which the photosensitive device is wholly exposed thus forming an electrostatic latent image on the insulating layer.

(2) A method having a first step in which the photosensitive body is negatively charged by a D.C. charger, a second step in which the photosensitive device is positively charged and, at the same time, exposed to the light image, and a third step in which the photosensitive device is wholly exposed.

(3) A method having a first step in which the photosensitive body is negatively charged by a D.C. charger, a second step in which the photosensitive device is charged by an A.C. charger and, at the same time, exposed to the light image, and a third step in which the photosensitive device is wholly charged.

The electrostatic latent image formed by one of the methods explained above is then visualized by a developing agent and the thus obtained visible image is transferred to a transfer paper thus producing a copy. After the final copy of the electrostatic latent image is produced, the electrostatic lateral image has to be erased by the removal of the electrostatic charge, in advance of producing a copy of the next image.

A typical conventional method of removing the electrostatic charge is to subject the photosensitive device to an irradiation by light and, at the same time, to an A.C. charge by an A.C. corona discharge. This method, however, cannot perfectly remove the electrostatic charge. Namely, although the potential of the photosensitive device is reduced to a level near 0 V immediately after the removal of the charge, the potential is shifted to a level of 50 to 150 V due to the presence of relaxative residual charge. The level to which the potential is shifted varies depending on the position. For instance, in the portion of the photosensitive body in which a dark portion of the electrostatic latent image has been formed, the potential level is shifted to 150 V, while the portion in which the bright portion of the image has been formed exhibits a potential shift to 50 V. Therefore, when the copy of the next image is produced by using the photosensitive device from which the charges have been removed by the method described before, the density of the image is undesirably decreased and the quality of the image is impaired due to ghosting and/or fog.

In another known method of removing the electrostatic charge, it has been proposed to charge the photosensitive device by a D.C. charger to the polarity reverse to the residual potential, while subjecting the photosensitive device to an exposure over its entire area. For instance, when the level of the residual latent image is −500 V, a charging is effected by a positive corona charger and, at the same time, the whole surface is exposed to remove the electrostatic charge. In this method, the positive corona voltage is adjusted in accordance with the potential of the residual latent image such that a residual potential of about 0 V is obtained after the removal of the charge. Unfortunately, however, this method cannot perfectly remove the electrostatic charge and, in addition, cannot effect the control of residual potential in the areas in which bright portions of the image have been formed and the residual potential has been about +50 V. With this method, therefore, it is impossible to make uniform the residual potential level over the entire area of the photosensitive device. For obtaining an equal residual potential level in the area in which the bright portion of the image has been formed and in the area in which a dark portion of the image has been formed, it is necessary to employ a corona voltage of a sufficiently high level to equalize the potential level in the area where the dark portion of the image has been formed to the potential level of the area in which the bright portion of the image has been formed. Unfortunately, however, when the levels of the residual potential are equalized, the initial potential level is largely offset in one direction when the new latent image is formed, so that the control of potential levels in the bright and dark portions is disadvantageously made unstable.

SUMMARY OF THE INVENTION

Accordingly, an object of the invention is to provide a method which can permit substantially perfect removal of electrostatic charge from a photosensitive device thereby to avoid any shift of potential level after the removal of the electrostatic charge.

To this end, according to the invention, there is provided a method of removing electrostatic charge in a process for producing a copy having the steps of forming, in an electrophotographic photosensitive device having a conductive layer overlain by a photoconductive layer which in turn is overlain by a transparent insulating layer, an electrostatic latent image by an image forming process which includes at least an exposure to a light image simultaneously with a D.C. or A.C. charging and, after making a copy from the electrostatic latent image, erasing the electrostatic latent image by removing the residual electrostatic charge, wherein the method of removing electrostatic charge from the photosensitive device comprises: a first step of uniformly charging the photosensitive device by a D.C. charger while subjecting the photosensitive device to an exposure over the whole area thereof; a second step of effecting a charging for adjustment of potential level so as to adjust the potential of the photosensitive device from the level obtained as a result of the charging in the first step to the aimed level; and a third step of exposing the whole area of the photosensitive device.

With this method, it is possible to almost perfectly remove the residual electrostatic charge from the photosensitive device to eliminate any shift of potential level which may otherwise be caused by relaxative residual charge such as to avoid any ghosting and fog thereby assuring a high degree of clarity and density of the copy in the next copying operation.

The above and other objects, features and advantages of the invention will become clear from the following description of the preferred embodiments when the same is read in conjunction with the accompanying drawings.

DESCRIPTION OF THE PREFERRED EMBODIMENTS

Preferred embodiments of the invention will be described hereinunder with reference to the accompanying drawings.

Figure 1:
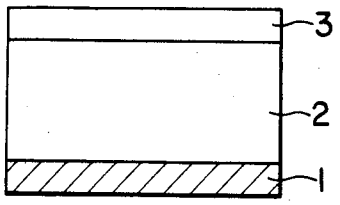
FIG. 1 is a schematic sectional view of an example of an electrophotographic photosensitive device to which the method of the invention for removing electrostatic charge is applied.

FIG. 1 shows an example of a photosensitive device to which the charge removing method of the invention is applied. The photoconductive device is constituted by an Ni conductive layer 1. A Se layer of 50 μm thick is formed by a vacuum evaporation. On the Se layer thus formed, a Se-Te alloy layer having a thickness of 0.5 μm and containing 10% Te is formed also by vacuum evaporation. The Se layer and the Se-Te alloy layer in combination constitute a photoconductive layer 2. Subsequently, an insulating layer 3 made of urethane resin of 30 μm is formed on the photoconductive layer 2, thus completing an electrophotographic photosensitive device.

Figure 2:
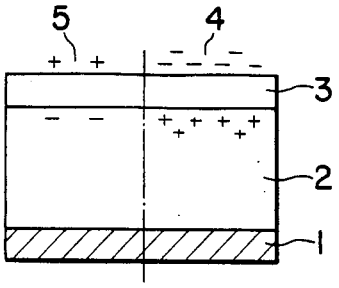
FIG. 2 is an illustration of the photosensitive device shown in FIG. 1 carrying an electrostatic latent image formed therein.

In making a copy of an image, an electrostatic latent image is formed on the electrophotographic photosensitive device in accordance with the following procedure. Namely, a primary charging is effected by a scorotron charger to a potential of −2500 V. Subsequently, a positive corona charge is imparted by maintaining the wire voltage at +6.5 KV and, at the same time, the photosensitive device is exposed to a light image at a rate of 5 lux sec. Finally, the whole area of the photosensitive device is exposed. In consequence, as shown in FIG. 2, an electrostatic latent image is formed to have a dark portion 4 and a bright portion 5 the potentials of which are, for example, −350 V and +100 V, respectively. This electrostatic latent image is visualized by a toner and is transferred to a transfer paper thus forming a copy of the image.

The residual electrostatic latent image as shown in FIG. 2 has to be erased before the copying of a new image.

According to a first embodiment of the invention, the removal of the electrostatic charge is conducted in the manner explained hereinunder.

Figure 3A:
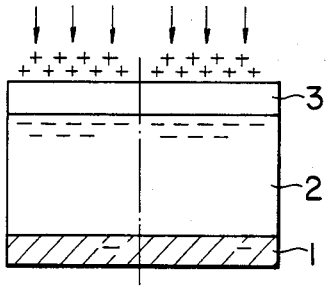
FIGS. 3A to 3C are illustrations of states of charging of the photosensitive device in different steps of the first embodiment of the charge removing method of the invention.
Figure 3B:
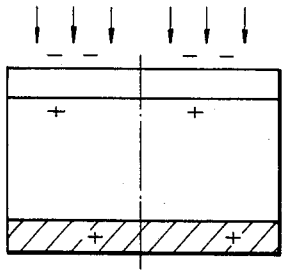

As the first step, as shown in FIG. 3A, a positive corona charge is imparted to the photosensitive device by applying a D.C. voltage of +7 KV to the same by means of a corotron charger and, at the same time, the whole area of the photosensitive device is irradiated with light at a rate of 100 lux sec. Then, as shown in FIG. 3B, a negative corona charging is conducted by selecting the grid voltage and the wire voltage of a scorotron charger to be −50 V and −6 KV, respectively, such as to obtain a potential of −50 V on the photosensitive device. In this step of potential adjusting negative charging, an exposure of the whole area may be conducted for the purpose of supplementation of the exposure of the whole area which is to be conducted in the next step. Finally, the whole area is exposed thus completing the removal of the electrostatic charge.

An electrostatic latent image of a new original was formed on the photosensitive device from which the electrostatic charge had been removed by the above-described method, and a copy was obtained from this electrostatic latent image. As a result, a clear copy suffering from no ghosting nor fog was obtained, proving an almost perfect removal of the electrostatic charge of the previous image from the photosensitive device.

Figure 4A:
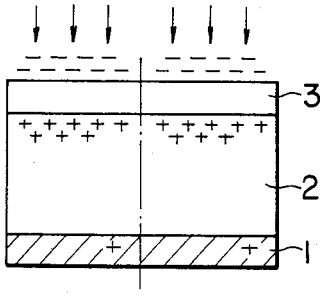
FIGS. 4A to 4C are illustrations of a modification of the embodiment shown in FIGS. 3A to 3C.
Figure 4B:
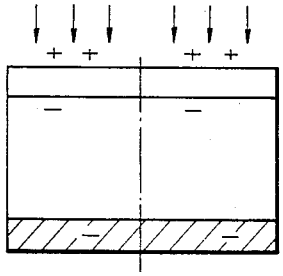

In the first embodiment described hereinbefore, positive corona charging by a corotron charger is used as the means for the initial D.C. charging simultaneously with the exposure of the whole area, while the charging for adjusting the potential level is conducted as a negative corona charging which is effected by a scorotron charger. This, however, is not exclusive and the first embodiment can be modified as shown in FIGS. 4A to 4C. Namely, in this modification, the polarities of the charges are reversed such that the initial D.C. charging is effected as a negative corona charging by means of a corotron charger, and the next charging for adjustment of the potental level is conducted as a positive corona charging. It was confirmed that the modification shown in FIGS. 4A to 4C provides an effect equivalent to that produced by the embodiment shown in FIGS. 3A to 3C.

Figure 3C:
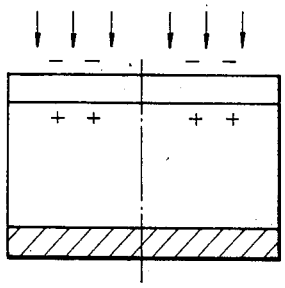
Figure 4C:
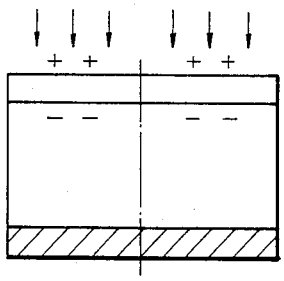

In the first embodiment shown in FIGS. 3A to 3C, as well as in the modification shown in FIGS. 4A to 4C, the effect of removal of charge was enhanced when the D.C. charging in the first step is continued until the potential levels in the regions where the dark and bright portions of the image were formed are equalized.

The method of the first embodiment was applied experimentally to the removal of charge of electrostatic latent images which were formed by other image-forming methods than that described above to confirm equivalent effects of removal of electrostatic charge.

Thus, in the first embodiment of the invention, the first step is conducted by effecting a D.C. charging simultaneously with the exposure of the whole area, by applying to the charger a voltage which is equal to or higher than the absolute value of the D.C. voltage or the effective value of the A.C. voltage which was applied in the step in which the charging and the image exposure are conducted simultaneously in the process for forming the electrostatic latent image, and by allowing an exposure over the whole area by a quantity of light which is equal to or greater than that applied in the step in which the charging and the image exposure are conducted simultaneously in the process for forming the electrostatic latent image. After finishing this first step, a second step for adjustment of the potential level is conducted by effecting a D.C. charging in the reverse polarity to the first step, followed by a third step in which the whole area is exposed, thus removing the residual electrostatic charge almost completely. Consequently, the undesirable shift of the potential level after the removal of electrostatic charge is advantageously avoided. If the voltage and light quantity applied in the first step are below those applied in the formation of the electrostatic latent image, the removal of electrostatic charge is liable to become imperfect because the levels of the residual potential in the regions where the dark and bright portions of the images have been formed are not equalized satisfactorily.

If the first step in the first embodiment is followed by an additional step consisting of a D.C. charging in the reverse polarity to that in the first step and an exposure of the whole area, any difference in the easiness of erasion due to presence of positive or negative charges in the photoconductive layer in the photosensitive device is eliminated to assure a higher effect of removal of electrostatic charge.

FIGS. 5A to 5D show a second embodiment of the invention which employs the above-mentioned additional step.

As in the case of the first step in the method of the first embodiment, the first step of this second embodiment is conducted by imparting a positive corona charge to a photosensitive device carrying a residual latent image and, at the same time, subjecting the whole area of the photosensitive device to an exposure. The positive corona charging is effected by a corotron charger to which is applied a D.C. voltage which is equal to or higher than the absolute value of the D.C. voltage or the effective value of the A.C. voltage applied in the step in which the charging and the image exposure are conducted simultaneously in the process for forming the electrostatic latent image. At the same time, the quantity of light received in this first step should be equal to or greater than that received during the step in which the charging and the image exposure are conducted simultaneously in the process for forming the electrostatic latent image. The positive corona charging is continued, at the shortest, until the levels of the potentials in the regions where the dark and bright portions of the latent image were formed are equalized.

In the next step of the second embodiment, a negative corona charging is effected by the corotron charger to which is applied a voltage of the same level as the voltage in the first step but of the reverse polarity and, at the same time, the whole area is exposed to a light of a quantity substantially the same as that employed in the first step. This step will be referred to as "reverse-polarity D.C. charging/whole exposure step".

Figure 5A:
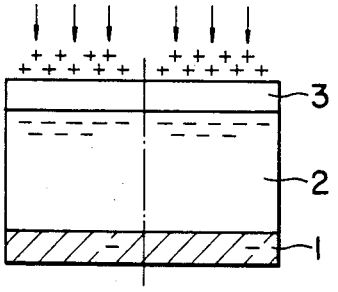
FIGS. 5A to 5D are illustrations of states of charging of the photosensitive device in different steps of a second embodiment of the charge removing method in accordance with the invention.
Figure 5B:
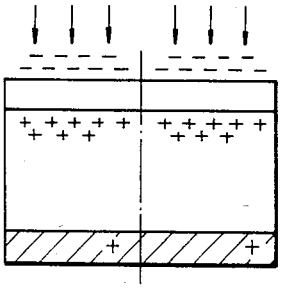
Figure 5C:
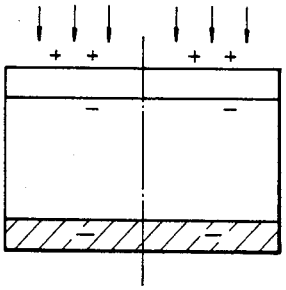

Then, as a third step, a positive corona charging is effected by a scotron charger for the purpose of adjustment of the potential level, as shown in FIG. 5C. This third step can employ a whole exposure.

Figure 5D:
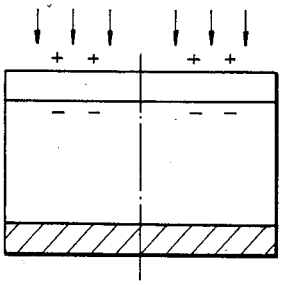

Then, as the final step, the whole area is exposed as shown in FIG. 5D thus completing the removal of the electrostatic charge.

Thus, the second embodiment employs the "reverse-polarty D.C. charging/whole exposure step" as the additional step subsequent to the first step in the first embodiment. This second embodiment can be modified in the same way as the modification to the first embodiment, without impairing the advantage of the invention.

In the first and second embodiments described hereinbefore, a positive or negative charging by a D.C. charger is conducted as the charging for adjusting the potential level of the photosensitive device. This, however, is not exclusive and the invention does not exclude the use of an A.C. charging or a charging by a biased A.C. voltage which is produced by superposing a D.C. voltage to an A.C. voltage, in place of the D.C. charging employed in the first and the second embodiments. By using such A.C. charging, it is possible to substantially reduce the residual potential to zero after the removal of the charge and, hence, to attain a more perfect charge removing effect.

Figure 6A:
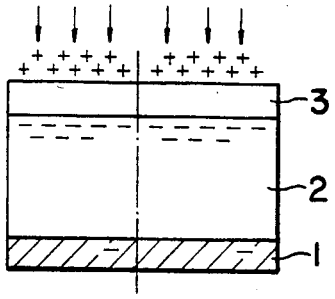
FIGS. 6A to 6C are illustrations of states of charging of the photosensitive device in different steps of a third embodiment of the charge removing method in accordance with the invention.
Figure 6B:
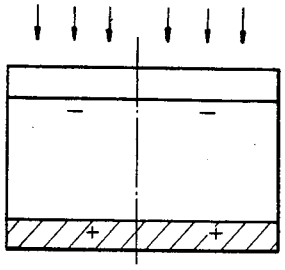
Figure 6C:
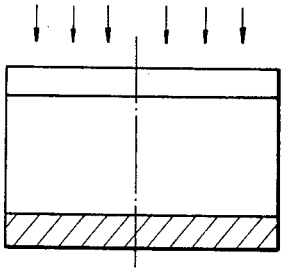

FIGS. 6A to 6C show a third embodiment of the invention which employs A.C. charging for adjusting the potential level of the photosensitive device.

A description will be made hereinunder as to how this third embodiment is applied to the erasion of an electrostatic image formed by an image forming process other than that explained in connection with the first and second embodiments, although this third embodiment can be applied equally to the same photosensitive device and the electrostatic latent image as those mentioned in the description of the first and second embodiments.

Namely, in this case, the electrophotographic photosensitive device has a mirror-finished conductive layer of Al. A Se layer of 50 μm thick is formed on the conductive layer of Al by vacuum evaporation, on which is formed further a Se-Te alloy layer having a thickness of 0.5 μm and containing 14% Te, also by vacuum evaporation. The Se layer and the Se-Te alloy layer in combination constitute a photoconductive layer. Then, an insulating layer consisting of polyethylene terephthalate film of 25 μm thick is adhered to complete the electrophotographic photosensitive device.

The formation of an electrostatic latent image was formed in accordance with the following process. Namely, the photosensitive device was exposed to a light image at a rate of 5 lux sec while being subjected to a positive corona charging effected by a corotron charger to which was applied a voltage of +6.5 KV. Then, a charging was conducted in darkness by means of a scorotron charger with the grid and wire maintained at voltages of −800 V and −7 KV, respectively. Finally, the whole area of the photosensitive device was exposed. Consequently, an electrostatic latent image was obtained to have a dark portion and a bright portion the potentials of which were −450 V and +100 V, respectively. This latent image was developed by a toner and was transferred to a transfer paper to obtain a copy of the image.

Then, for the copying of a new orignal, the latent image was erased through removal of the electrostatic charge from the photosensitive device. The removal of the electrostatic charge was conducted in accordance with the third embodiment as follows.

As the first step, the whole area of the photosensitive body was irradiated with light at a rate of 100 lux sec, while being subjected to a positive corona charge effected by a corotron charger to which was applied a D.C. voltage of +7 KV, as shown in FIG. 6A.

Then, as the second step, a charging was effected to obtain a potential of −20 V on the photosensitive device, by applying to the corotron charger a biased A.C. voltage which was obtained by superposing a D.C. voltage of +500 V to an A.C. voltage of 6 KV. In this step of A.C. corona charging, the whole area of the photosensitive device may be exposed in order to supplement the exposure of the whole area which is to be conducted in the next step. Finally, the whole area was exposed to remove the electrostatic charge.

A copy of a new image was obtained by forming an electrostatic latent image on the photosensitive device from which the electrostatic charge had been removed in the manner described. The copy thus obtained was sufficiently clear without suffering from any ghosting or fog. It was thus confirmed that the third embodiment ensures a substantially perfect elimination of shift of the potential level through an almost complete removal of the electrostatic charge.

Figure 7A:
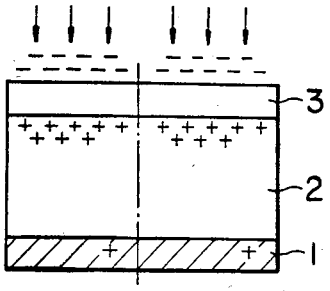
FIGS. 7A to 7C are illustrations of a modification of the third embodiment shown in FIGS. 6A to 6C.
Figure 7B:
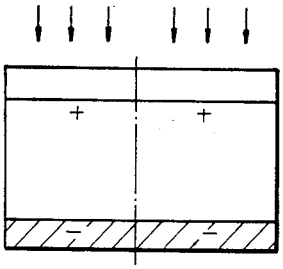
Figure 7C:
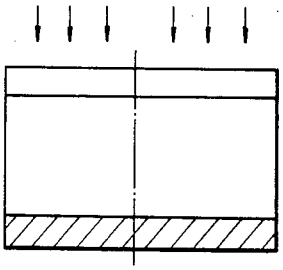

In the third embodiment described hereinbefore, positive corona charging by a corotron charger is conducted simultaneously with exposure of the whole area in the first step, followed by a second step in which A.C. corona charging is conducted for the purpose of adjustment of the potential level. This third embodiment, however, can be modified as shown in FIGS. 7A to 7C. More specifically, in this modification, the D.C. charging in the first step is conducted in the polarity reverse to that in the first step of the third embodiment, i.e., in the negative polarity, by means of a corotron charger, followed by a potential adjustment by an A.C. corona charging. A result equivalent to that produced by the third embodiment was confirmed with this modification shown in FIGS. 7A to 7C.

In the third embodiment, as well as in the modification, a greater charge removing effect was obtained by continueing the D.C. charging until the potential levels in the regions where the dark and bright portions of the image have been formed are equalized.

For a more complete removal of the electrostatic charge, the A.C. corona charging for the potential level adjustment is conducted over a period long enough to reduce the potential level of the photosensitive device to substantially 0 (zero)V, typically 0.05 to 0.5 sec.

It is to be understood that, even if an A.C. voltage of sine-wave form is applied to the charger during the A.C. corona charging, the corona current produced by the charger does not conform with the sine-wave form but is slightly offset to the negative side. In order to substantially nullify the potential of the photosensitive device, therefore, it is preferred to suitably adjust the voltage applied to the charger by superposing a D.C. voltage to the A.C. voltage to be applied. This, however, is not essential and the adjustment of the potential level to a satisfactory degree is possible without the superposition of the D.C. voltage.

The method of the third embodiment was applied experimentally to the removal of charge of electrostatic latent images which were formed by other image-forming methods than that described above to confirm equivalent effects of removal of electrostatic charge.

Thus, in the third embodiment of the invention, the first step is conducted by effecting a D.C. charging simultaneously with the exposure of the whole area, by applying to the charger a voltage which is equal to or higher than the absolute value of the D.C. voltage or the effective value of the A.C. voltage which was applied in the step in which the charging and the image exposure are conducted simultaneously in the process for forming the electrostatic latent image, and by allowing an exposure over the whole area by a quantity of light which is equal to or greater than that applied in the step in which the charging and the image exposure are conducted simultaneously in the process for forming the electrostatic latent image. After finishing this first step, a second step for adjustment of the potential level is conducted by effecting an A.C. corona charging, followed by a third step in which the whole area is exposed, thus removing the residual electrostatic charge almost completely. Consequently, the undesirable shift of the potential level after the removal of electrostatic charge is avoided advantageously.

If the first step in the third embodiment is followed by an additional step consisting in a D.C. charging in the reverse polarity to that in the first step and an exposure of the whole area, any difference in the easiness of erasion due to the presence of positive or negative charges in the photoconductive layer in the photosensitive device is eliminated to assure a higher effect of removal of electrostatic charge.

FIGS. 8A to 8D show a fourth embodiment of the invention which employs the above-mentioned additional step.

As in the case of the first step in the method of the third embodiment, the first step of this fourth embodiment is conducted by imparting a positive corona charge to a photosensitive device carrying a residual latent image and, at the same time, subjecting the whole area of the photosensitive device to an exposure. The positive corona charging is effected by a corotron charger to which is applied a D.C. voltage which is equal to or higher than the absolute value of the D.C. voltage or the effective value of the A.C. voltage applied in the step in which the charging and the image exposure is conducted simultaneously in the process for forming the electrostatic latent image. At the same time, the quantity of light received in this first step should be equal to or greater than that received during the step in which the charging and image exposure are conducted simultaneously in the process for forming the electrostatic latent image. The positive corona charging is continued, at the shortest, until the levels of the potentials in the regions where the dark and bright portions of the latent image were formed are equalized.

Figure 8A:
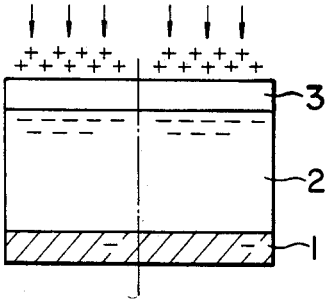
FIGS. 8A to 8D are illustrations of states of charging of the photosensitive device in different steps of a fourth embodiment of the charge removing method in accordance with the invention.
Figure 8B:
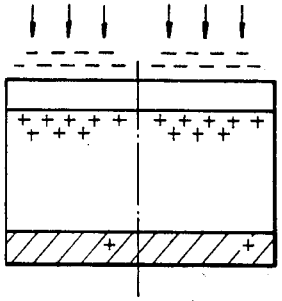

In the next step of the fourth embodiment, as shown in FIG. 8B, a negative corona charging is effected by the corotron charger to which is applied a voltage of the same level as the voltage in the first step but of the reverse polarity and, at the same time, the whole area is exposed to light of a quantity substantially the same as that employed in the first step (reverse-polarity D.C. charging/whole exposure step).

Figure 8C:
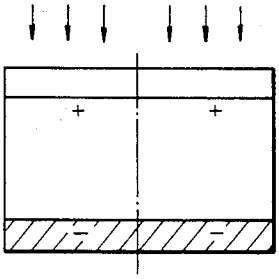

Then, as a third step, a corona charging is effected by an A.C. corona charger with superposition of a D.C. voltage as required by means of a corotron charger for the purpose of adjustment of the potential level, as shown in FIG. 8C. This third step can employ a whole exposure.

Figure 8D:
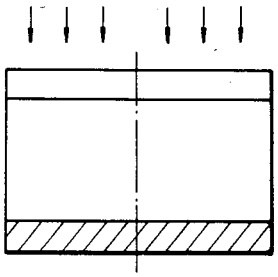

Then, as the final step, the whole area is exposed as shown in FIG. 8D thus completing the removal of the electrostatic charge.

Thus, the fourth embodiment employs the "reverse-polarity D.C. charging/whole exposure step" as the additional step subsequent to the first step in the third embodiment. This fourth embodiment can be modified in the same way as the modification to the third embodiment, without impairing the advantage of the invention.

Although applications of the embodiments to the erasion of electrostatic images formed by three different processes have been described by way of examples, it is to be noted that the invention can be applied to any other electrophotographic photosensitive device having a laminated structure constituted by a conductive layer, photoconductive layer on the conductive layer and a transparent insulating layer on the photoconductive layer, as well as to the erasion of electrostatic images formed by processes other than those described.

What is claimed is:

1. In a process for producing a copy having the steps of forming, in an electrophotographic photosensitive device having a conductive layer overlain by a photoconductive layer which in turn is overlain by a transparent insulating layer, an electrostatic latent image by an image forming process which includes at least an exposure to a light image simultaneously with a D.C. or A.C. charging and, after making a copy from said electrostatic latent image, erasing said electrostatic latent image by removing the residual electrostatic charge, the improvement comprising:

a method of removing electrostatic charge from said photosensitive device comprising: a first step of uniformly charging said photosensitive device by a D.C. charger while subjecting said photosensitive device to an exposure over the whole area thereof; a second step of effecting a charging for adjustment of potential level so as to adjust the potential of said photosensitive device from the level obtained as a result of the charging in the first step to the desired level; and a third step of exposing the whole area of said photosensitive device, wherein the voltage applied to said D.C. charger in said first step including the D.C. charging and exposure of the whole area is equal to or higher than the absolute value of the D.C. voltage or the effective value of the A.C. voltage applied during the step in which the charging and that imaging exposure are conducted simultaneously for forming the electrostatic latent image and is continued for a time, at the shortest, until the levels of potential in the regions of said photosensitive device in which the dark and bright portions of such image have been formed are equalized, and wherein the quantity of light to which said photosensitive device is exposed in said first step is equal to or greater than the quantity of light applied in the step in which the charging and image exposure are conducted simultaneously in the process for forming the electrostatic latent image.

2. A method of removing electrostatic charge according to claim 1, wherein said step for effecting a charging for adjusting the potential level is conducted by a D.C. charging in the polarity reverse to the polarity of the D.C. charging in said first step.

3. A method of removing electrostatic charge according to claim 2, wherein the D.C. charging in the reverse polarity in said step for effecting the charging for adjustment of potential is conducted by means of a scorotron charger.

4. A method of removing electrostatic charge according to claim 1, wherein said step for effecting a charging for adjusting the potential level is conducted by a D.C. charging in the polarity reverse to the polarity of the D.C. charging in said first step.

5. A method of removing electrostatic charge according to claim 1, wherein said step for effecting a charging for adjusting the potential level is conducted by a D.C. charging in the polarity reverse to the polarity of the D.C. charging in said first step.

6. A method of removing electrostatic charge according to claim 1, wherein said step for effecting a charging for adjusting the potential level is conducted by an A.C. charging or by a biased A.C. charging which is formed by superposing a D.C. voltage to the A.C. voltage.

7. A method of removing electrostatic charge according to claim 6, wherein the A.C. charging or the charging by the biased A.C. voltage is continued until the potential of said photosensitive device becomes substantially zero or near an aimed level.

8. A method of removing electrostatic charge according to claim 1, wherein said step for effecting a charging for adjusting the potential level includes an exposure of the whole area of said photosensitive device.

9. In a process for producing a copy having the steps of forming, in an electrophotographic photosensitive device having a conductive layer overlain by a photoconductive layer which in turn is overlain by a transparent insulating layer, an electrostatic latent image by an image forming process which includes at least an exposure to a light image simultaneously with a D.C. or A.C. charging and, after making a copy from said electrostatic latent image, erasing said electrostatic latent image by removing the residual electrostatic charge, the improvement comprising:

a method of removing electrostatic charge from said photosensitive device comprising: a first step of uniformly charging said photosensitive device by a D.C. charger while subjecting said photosensitive device to an exposure over the whole area thereof; a second step of effecting a charging by a D.C. charger in the reverse polarity to that in said first step while exposing the whole area of said photosensitive device so as to uniformly charge said photosensitive device in the reverse polarity; a third step of effecting a charging for adjustment of the potential so as to adjust the potential of said photosensitive device from the level obtained as a result of the charging in the second step to the desired devel; and a fourth step of exposing the whole area of said photosensitive device, wherein the D.C. charging in said first step in which the D.C. charging and the exposure of the whole area is conducted simultaneously is continued, at the shortest, until the levels of potential in the regions of said photosensitive device in which the dark and bright portions of said image are formed are equalized, wherein the absolute value of the voltage appiled to said D.C. charger in said first step in which the D.C. charging and the exposure of the whole area are conducted simultaneously and in said second step in which the D.C. charging in the reverse polarity and the exposure of the whole area are conducted simultaneously is equal to or greater than the absolute value of the D.C. voltage or the effective value of the A.C. voltage applied to the charger in the step in which the charging and image exposure are conducted simultaneously in the process for forming the electrostatic latent image, and wherein the quantity of light to which said photosensitive device is exposed in said first and second steps is equal to or greater than the quantity of light to which said photosensitive device is exposed in the step in which the charging and the image exposure are conducted simultaneously in the process for forming the electrostatic latent image.

10. A method of removing electrostatic charge according to claim 9, wherein said step for effecting a charging for adjusting the potential level is conducted by a D.C. charging in the polarity same as the polarity of the D.C. charging in said first step.

11. A method of removing electrostatic charge according to claim 10, wherein the D.C. charging in said step for effecting the charging for adjustment of potential is conducted by means of a scorotron charger.

12. A method of removing electrostatic charge according to claim 9, wherein said step for effecting a charging for adjusting the potential level is conducted by a D.C. charging in the polarity same as the polarity of the D.C. charging in said first step.

13. A method of removing electrostatic charge according to claim 9, wherein said step for effecting a charging for adjusting the potential level is conducted by a D.C. charging in the polarity same as the polarity of the D.C. charging in said first step.

14. A method of removing electrostatic charge according to claim 9, wherein said step for effecting a charging for adjusting the potential level is conducted by an A.C. charging or by a biased A.C. charging which is formed by superposing a D.C. voltage to the A.C. voltage.

15. A method of removing electrostatic charge according to claim 14, wherein the A.C. charging or the charging by the biased A.C. voltage is continued until the potential of said photosensitive device becomes substantially zero or near an aimed level.

16. A method of removing electrostatic charge according to claim 9, wherein said step for effecting a charging for adjusting the potential level includes an exposure of the whole area of said photosensitive device.

* * * * *